United States Patent [19]

Lewis et al.

[11] 4,096,912

[45] Jun. 27, 1978

[54] METHODS FOR MINIMIZING PLASTIC FLOW OF OIL SHALE DURING IN SITU RETORTING

[75] Inventors: Arthur E. Lewis, Los Altos; Richard G. Mallon, Livermore, both of Calif.

[73] Assignee: The United States of America as represented by the United States Department of Energy, Washington, D.C.

[21] Appl. No.: 804,194

[22] Filed: Jun. 6, 1977

[51] Int. Cl.[2] ..... E21B 43/24; E21B 43/26

[52] U.S. Cl. ..... 166/259; 166/261; 166/281; 166/288

[58] Field of Search ..... 166/259, 261, 266, 267, 166/281, 288, 303; 299/2

[56] References Cited

U.S. PATENT DOCUMENTS

| | | | |
|---|---|---|---|
| 1,361,282 | 12/1920 | Nolan | 166/288 |
| 2,973,813 | 3/1961 | Parker | 166/261 X |
| 3,346,044 | 10/1967 | Slusser | 166/259 X |
| 3,526,172 | 9/1970 | Stuart | 166/292 X |
| 3,548,938 | 12/1970 | Parker | 166/256 |
| 3,566,967 | 3/1971 | Shelton et al. | 166/261 |
| 3,630,278 | 12/1971 | Parker | 166/259 |
| 3,945,679 | 3/1976 | Closmann et al. | 166/281 X |
| 4,015,664 | 4/1977 | Acheson et al. | 166/259 |
| 4,017,119 | 4/1977 | Lewis | 299/2 |
| 4,036,299 | 7/1977 | Cha et al. | 166/259 X |

OTHER PUBLICATIONS

Denver Research Institute, "Disposal and Uses of Oil Shale Ash," NTIS PB-234208, Apr. 1970.

*Primary Examiner*—Stephen J. Novosad
*Assistant Examiner*—George A. Suchfield
*Attorney, Agent, or Firm*—Dean E. Carlson; Roger S. Gaither; Irene S. Croft

[57] ABSTRACT

In an in situ oil shale retorting process, plastic flow of hot rubblized oil shale is minimized by injecting carbon dioxide and water into spent shale above the retorting zone. These gases react chemically with the mineral constituents of the spent shale to form a cement-like material which binds the individual shale particles together and bonds the consolidated mass to the wall of the retort. This relieves the weight burden borne by the hot shale below the retorting zone and thereby minimizes plastic flow in the hot shale. At least a portion of the required carbon dioxide and water can be supplied by recycled product gases.

8 Claims, No Drawings

METHODS FOR MINIMIZING PLASTIC FLOW OF OIL SHALE DURING IN SITU RETORTING

BACKGROUND OF THE INVENTION

The invention described herein was made in the course of or under Energy Research and Development Administration Contract No. W-7405-ENG-48 with the University of California.

This invention relates to improvements in the recovery of oil from subsurface oil shale formations. More particularly, this invention relates to a method for minimizing plastic flow of hot shale during in situ retorting.

Many of the potentially most productive oil shales are covered by deep overburdens and are not readily amenable to mining. Considering current day liquid fuel requirements it is essential that a practical in situ technique be developed for processing oil shales. Basically, underground processing involves first, some method of introducing permeablity into the formation, and, second, some method of heat injection that will cause pyrolysis of the organic matter in the shale to yield useful products.

Permeability is best introduced into the formation by rubblization, a process which introduces both fractures and space into the oil shale. An underground rubble region can be created by conventional mining methods or by modifications thereof. For example, a modified sublevel-caving method of mining has been proposed to produce oil shale rubble suitable for in situ retorting on a commercial scale. An improvement in this method is described in detail in the application of Arthur E. Lewis, Ser. No. 670,478, filed Mar. 25, 1976, now U.S. Pat. No. 4,017,119, issued Apr. 12, 1977, which is incorporated herein by reference. The proposed method is also described in detail in the report UCRL-51768, "Rubble In Situ Extraction (RISE): A Proposed Program for Recovery of Oil from Oil Shale", by A. E. Lewis and A. J. Rothman, Mar. 5, 1975, available from National Technical Information Service, U.S. Department of Commerce, 5285 Port Royal Road, Springfield, Virginia 22151.

Retorting of the rubblized oil shale is then accomplished by causing hot gases to flow through the shale to decompose the kerogen therein and release the oil. A preferred method, described in the cited report, involves igniting the oil shale at the top of the rubble column and promoting downward movement of the combustion zone. The hot gases from the combustion zone flow downward, decompose the oil shale in an area referred to in the art as the retorting zone, and heat the rubblized shale below the retorting zone. A zone of spent (burned) shale is thus created above the retorting zone.

A particular problem encountered in retorting oil shale by the above-described method is plastic flow of hot rubblized shale. This plastic flow tends to plug the high permeability flow paths through the rubblized shale, thereby increasing the pressure gradient needed to drive the retorting gases through the shale. The problem becomes acute when the hot retorting zone has progressed for some distance through the column of rubblized shale. The weight of the spent (burned) shale then becomes appreciable enough to compress the hot unretorted shale below the retorting zone. The resulting plastic flow of the hot shale can drastically reduce porosity and permeability, eventually stopping flow of the retorting gases through the shale column.

SUMMARY OF THE INVENTION

In accordance with the present invention, such plastic flow of hot rubblized oil shale is minimized by introducing sufficient carbon dioxide and water into the spent shale above a downwardly moving retorting zone to react with the mineral constituents of the spent shale and thereby form a cement-like material which binds the individual shale particles together and bonds the consolidated mass to the wall of the retort. Thus, the weight burden borne by the hot rubblized shale below the retorting zone is relieved and plastic flow therein is minimized.

It has also been found that the carbonaceous residue or char in the spent shale interferes with interparticle bonding, and, therefore, it is preferred to burn the spent shale to remove such residue prior to introduction of $CO_2$ and $H_2O$. Since preferred retorting practice involves combustion of the carbonaceous residue remaining in the oil shale formation after distillation of oil, the removal of the interfering carbonaceous char is effected during the retorting operation.

In a preferred embodiment, product gases from the retorting zone are burned to produce power and part of the resulting exhaust gas is injected to provide at least a portion of the required $CO_2$ and $H_2O$.

It is, therefore, an object of this invention to provide an improved method for recovering oil from subsurface oil shale formations.

More particularly, it is an object of this invention to provide a method for minimizing plastic flow of hot shale during in situ retorting.

Other objects and advantages will become apparent from the following detailed description.

DETAILED DESCRIPTION OF THE INVENTION

Broadly, the present invention comprises establishing a downwardly moving retorting zone in a rubblized region of a subsurface oil shale formation, thereby creating a zone of spent shale above a hot, rubblized oil shale zone, and introducing $CO_2$ and $H_2O$ into the spent shale in amounts sufficient to react with the mineral constituents of the spent shale and form a cement-like material which binds the individual shale particles together and to the wall of the retort. The spent shale is thus cemented in situ, greatly reducing the rubble pressure on the hot, rubblized oil shale in the lower part of the retort, thereby reducing the problem of loss of permeability due to creep.

Preferably, the spent shale is burned prior to the cementation process in order to remove carbonaceous char which interferes with interparticle bonding. Product gases from the retorting zone are recycled preferably after combustion, to provide at least a portion of the required $CO_2$ and $H_2O$. In another preferred variation, the required $H_2O$ is introduced as steam.

The invention will be described more fully in context in a preferred in situ retorting process which, as stated above, involves combustion of the carbonaceous residue remaining in the oil shale formation after retorting.

A rubblized oil shale region is created in subsurface oil shale formation by a known method such as described in the above-cited references. Holes are then drilled into the rubble region to provide a gas inlet, product gas outlet, and an outlet for product oil. The oil shale is ignited at the top of the rubble region to establish a combustion zone therein. Once the combustion zone is established, it is advanced in a generally vertically downward direction by continuous or intermittent injection of an oxygen-containing gas, most suitably air. The hot gases from the combustion zone provide the heat necessary to retort the rubblized oil shale below the combustion front. In the retorting process the shale must be heated to a temperature of at least 700° F (371° C), generally in the range 700°–900° F (371°–482° C) to decompose the kerogen in the shale. Control of the retorting temperature is achieved by flow rate and/or oxygen content of the circulating oxygen-containing gas. The oxygen content of the circulating gas can be adjusted as necessary by partial recycling of exhaust gas or other gas void of $O_2$ or by oxygen addition.

Another method of in situ combustion which can be used involves the alternation of an oxygen-containing gas, such as air, with an oxygen-free gas. The former advances the combustion zone while the oxygen-free gas performs the major portion of the retorting by absorbing heat from the previously established combustion zone and advancing it into the rubblized shale to be retorted. The cycle is repeated as often as is necessary to maintain a retorting zone temperature of at least 700° F.

The oil distilled from the kerogen collects in the lower part of the rubble region and is pumped to the surface by conventional means. Product gases consisting of CO, $CO_2$, $H_2O$, $H_2$, $CH_4$ and other hydrocarbons are discharged to the surface by means of the product gas outlet, are cooled for removal of product oil, and are burned and recycled as required.

As the combustion front and retorting zone progress downwardly through the rubble chimney, the pressure of burned spent shale on the hot oil shale being retorted and yet to be retorted increases. The resulting stress causes the hot shale to become compacted and lose permeability. The allowable gas flow rate through the rubble chimney decreases, thus reducing the retorting rate.

In order to minimize this plastic flow of the hot, rubblized shale below the combustion zone, a mixture of carbon dioxide and water is introduced into the burned spent shale above the combustion zone. The $CO_2$ and $H_2O$ react chemically with the mineral constituents of the shale to form a cement-like material which bonds the shale particles together and to the walls of the subsurface retort. The composition of the $CO_2/H_2O$ mixture and the amount necessary for cementation depend upon the composition, especially the carbonate content, of the particular formation being retorted. The reactions which probably occur during the cementation process are outlined below.

The mineral portion of oil shale consists mainly of dolomite, $CaMg(CO_3)_2$, plus feldspar (metal silicates), quartz ($SiO_2$), and various clays. Reactions (1) – (3) below represent the decomposition of dolomite during retorting and the subsequent reaction with $CO_2$ and $H_2O$ to form a $CaCO_3$ cement-like material which bonds the spent shale to the retort wall. Reaction (4) shows the formation of a material resembling Portland cement from the mineral constituents of the spent shale. Reaction (5) shows the reaction of Portland cement with $H_2O$ to form a "set" cement which bonds the spent shale to the retort wall.

$$\underset{\text{dolomite}}{CaMg(CO_3)_2} \xrightarrow[\text{retorting}]{\text{combustion and/or}} CaO + MgO + 2CO_2 \quad (1)$$

$$(2)\ CaO + H_2O \rightarrow Ca(OH)_2$$

$$(3)\ Ca(OH)_2 + CO_2 \rightarrow CaCO_3 + H_2O$$

$$CaO + \text{clay} + \text{silicate} \xrightarrow[\text{retorting}]{\text{combustion and/or}} \underset{\text{"Portland Cement"}}{3CaO,\ SiO_2} \quad (4)$$

$$(5)\ 3CaO,\ SiO_2 + H_2O \rightarrow \text{"Portland Cement" (set)}$$

At least part of the $CO_2$ and $H_2O$ required for cementation can be supplied by recycle of the product gases to the burned shale zone. However, as a result of the cooling of the product gases for removal of product oil, the water therein is also removed from the gas stream. Therefore, it is necessary to supply additional water from an auxiliary source. According to the preferred mode of operation, product gases are recycled after oxidation of their fuel content, as for power production.

For a continuous mode of operation, which is generally the preferred mode, the $CO_2$ and $H_2O$ required for cementation is mixed with the retorting gas and the total gas mixture is continuously introduced into the underground retort. Thus, as the combustion front moves generally downward through the retort, the burned spent shale behind the front is cemented by reaction with the $CO_2$ and $H_2O$ in the total gas mixture so that pressure build-up of burned spent shale is minimized.

Consider, for example, a typical subsurface oil formation containing an average of about 20 gallons per ton of shale. A 100 × 100 × 300 ft retort containing about 150,000 tons of rubblized oil shale is created in situ by removing about 20% of the shale by the modified sublevel-caving method described in the referenced Lewis patent and report. Porosity is created and distributed by the blasting and drawing process. The rubble region is then provided with the necessary conduits and equipment, as known in the art, for injection of retorting gas and the $CO_2$ and $H_2O$ required for cementation, recovery of product oil, and discharge of product gases. A combustion front is established by igniting the oil shale at the top of the rubble chimney by means of, for example, a natural gas burner, and the front is advanced by the introduction of a total gas mixture containing air as the retorting gas component. A typical gas mixture comprises about 50% air, from about 5 – 10% $CO_2$, and from about 5 – 10% $H_2O$, the remainder being inert gases, particularly nitrogen. The rate of gas flow and the oxygen content of the circulating gas is regulated to provide a retorting zone temperature of at least 700° F. A gas flow rate, assuming an air content of about 50%, in the range of about 20,000 – 60,000 scfm advances the burn front about 5 – 6 ft/day, thus requiring about two months to complete the retorting process and produce about 3 million barrels of oil from the underground retort.

The $CO_2$ and $H_2O$ in the injected gas mixture react chemically with the burned shale behind the combustion front to form a consolidated mass which adheres to the sides of the retort. The flow of gas into the underground retort is continued until retorting is completed.

The following example, which is an experimental run designed to simulate in the laboratory actual in situ conditions, illustrates the process of the present invention.

EXAMPLE

Raw oil shale was first crushed to 0.375-inch pieces and then loaded into a cylinder 3 inches in diameter by 9 inches tall. The cylinder was fitted with a piston resting on top of the crushed shale and subjected to a constant load of 50 psi. Provision was made for simultaneously heating the shale and flowing selected gases through it, always under a compressive load of 50 psi. First, the crushed shale was retorted by heating in nitrogen to 500° C at a rate of 2° C/min. Heating was continued at 2° C/min for 30 minutes while gradually changing from flowing nitrogen to air; shale temperature was about 550° C at the onset of pure/air flow. Air flow was maintained for the next 2.5 hours while continuing to heat at 2° C/min until a temperature of 800° C was reached, thereby burning off the remaining char. The shale was held at 800° C under nitrogen flow for 24 hours thereby decomposing the carbonate minerals, and then cooled gradually to 100° C under nitrogen. The gas flow was then changed from nitrogen to a mixture of 85 mole percent $CO_2$ plus 15 mole percent $H_2O$. The shale was held at 100° C under flowing $CO_2/H_2O$ for the next 6 hours. The recovered shale specimen was then subjected to unconfined compressive lOading in a stress/-strain test. The test results showed that this shale specimen carried a maximum load of 166 pounds in unconfined compression, indicating that the burned shale in an in situ retort can be bonded into a load-bearing member of appreciable strength.

Experiments also showed that burning off the carbonaceous char remaining on the retorted shale is necessary for interparticle bonding. It was also found that the strongest bond resulted when the gas environment during cementation was a mixture of carbon dioxide and water vapor. The resulting bond is much weaker if either the carbon dioxide or the water vapor is absent.

Thus, the present invention affords a method for minimizing plastic flow of hot, rubblized oil shale during in situ retorting. By chemically reacting the burned oil shale in the upper part of the retort with carbon dioxide and water, the burned shale is cemented in situ. Such cementation greatly reduces the rubble pressure in the lower portion of the retort, thereby reducing the problem of loss-of-permeability due to creep.

Although the invention has been hereinbefore described with respect to specific embodiments, it will be appreciated that various modifications and changes may be made therein without departing from the true spirit and scope of the invention. Thus, it is not intended to limit the invention except by the terms of the following claims.

What we claim is:

1. In a method for recovering shale oil from a rubble region in a subsurface oil shale formation by in situ retorting wherein a kerogenpyrolyzing fluid is caused to flow through a retorting zone in the rubble region, thereby decomposing the kerogen and producing oil and gaseous products, product oil and product gases are recovered from the retorting zone, and the shale in the retorting zone becomes spent, the steps comprising:

establishing a downwardly moving retorting zone in the rubble region, thereby forming an upper zone of spent shale and a lower zone of hot, rubblized oil shale in the rubble region; and introducing carbon dioxide and water into the upper zone of spent shale in amounts sufficient to react with the mineral constituents of the spent shale and form a cement-like material which binds individual shale particles together and to the walls of the rubble region, thereby relieving the weight burden of the spent shale on the hot, rubblized oil shale in the lower zone and minimizing plastic flow of said hot, rubblized oil shale.

2. A method according to claim 1 further including the step of promoting combustion of the spent shale in the upper zone to remove carbonaceous residue therefrom.

3. A method according to claim 1 wherein at least a portion of the carbon dioxide and water required for cementation is supplied by recycling product gases into the rubble region.

4. A method according to claim 1 wherein at least a portion of the carbon dioxide and water required for cementation is supplied by burning product gases to provide gaseous combustion products and introducing the resulting gaseous combustion products into the rubble region.

5. A improved method for recovering shale oil from a rubble region in a subsurface oil shale formation by in situ retorting which comprises:

establishing a combustion zone in the upper portion of the rubble region to provide hot retorting gases;

causing the hot retorting gases to flow through at least a portion of the rubblized oil shale below the combustion zone to decompose the kerogen therein and produce oil and gaseous products, the oil shale thereby becoming spent;

promoting the movement of the combustion zone in a generally vertical downward direction, thereby forming an upper zone of burned spent shale above a lower zone of hot, rubblized oil shale in the rubble region;

introducing carbon dioxide and water into the upper zone of burned spent shale in amounts sufficient to react with the mineral constituents of the spent shale and form a cement-like material which binds the individual shale particles together and to the walls of the rubble region, thereby relieving the weight burden of the spent shale on the hot, rubblized oil shale in the lower zone and minimizing plastic flow of said hot, rubblized oil shale; and recovering product oil and gases from the rubble region.

6. A method according to claim 5 wherein at least a portion of the carbon dioxide and water required for cementation is supplied by recycling product gases into the rubble region.

7. A method according to claim 5 wherein at least a portion of the carbon dioxide and water required for cementation is supplied by burning product gases to provide gaseous combustion products and introducing the resulting gaseous combustion products into the rubble region.

8. A method according to claim 5 wherein the hot retorting gases and the carbon dioxide and water required for cementation are continuously introduced into the rubble region.

* * * * *